US011079149B2

(12) United States Patent
Papas et al.

(10) Patent No.: US 11,079,149 B2
(45) Date of Patent: Aug. 3, 2021

(54) SYSTEM AND METHOD OF DILUTING A LEAKED REFRIGERANT IN AN HVAC/R SYSTEM

(71) Applicant: Carrier Corporation, Farmington, CT (US)

(72) Inventors: Paul Papas, West Hartford, CT (US); Parmesh Verma, South Windsor, CT (US); Richard G. Lord, Murfreesboro, TN (US); Larry D. Burns, Avon, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 753 days.

(21) Appl. No.: 15/157,848

(22) Filed: May 18, 2016

(65) Prior Publication Data

US 2016/0363358 A1 Dec. 15, 2016

Related U.S. Application Data

(60) Provisional application No. 62/173,058, filed on Jun. 9, 2015.

(51) Int. Cl.

| | |
|---|---|
| ***F25B 49/02*** | (2006.01) |
| ***F25B 49/00*** | (2006.01) |
| ***F24F 11/36*** | (2018.01) |

(52) U.S. Cl.

CPC ..... *F25B 49/005* (2013.01); *F24F 11/36* (2018.01)

(58) Field of Classification Search

CPC ..... F25B 49/005; F25B 2500/222; F25B 2500/23; F25D 29/00; F24F 11/0015; F24F 11/36; F24F 2011/0084; F24F 11/37; F24F 11/38; F24F 11/72; F24F 13/00

USPC ..... 62/126, 129, 176.6, 186, 271, 331, 159

See application file for complete search history.

(56) References Cited

U.S. PATENT DOCUMENTS

| | | | | | |
|---|---|---|---|---|---|
| 1,938,833 | A | * | 12/1933 | Irons, Sr. | F24F 3/044 165/247 |
| 2,184,473 | A | * | 12/1939 | Scanlan | F26B 9/06 34/535 |
| 2,212,356 | A | * | 8/1940 | Shure | F24F 5/001 62/409 |
| 2,970,768 | A | | 2/1961 | Curran | |
| 3,421,576 | A | * | 1/1969 | Roane | B60H 1/00007 165/202 |
| 3,859,818 | A | | 1/1975 | Goettl | |
| 3,946,575 | A | * | 3/1976 | Barr | F24F 11/00 62/176.1 |
| 3,949,808 | A | * | 4/1976 | Gilles | F24F 3/056 165/210 |
| 3,982,583 | A | * | 9/1976 | Shavit | F24F 11/0001 165/249 |

(Continued)

FOREIGN PATENT DOCUMENTS

| | | | |
|---|---|---|---|
| JP | H08178397 | A | 7/1996 |
| JP | 2755003 | B2 | 5/1998 |

(Continued)

*Primary Examiner* — Ljiljana V. Ciric

(74) *Attorney, Agent, or Firm* — Cantor Colburn LLP

(57) ABSTRACT

A mitigation damper operably coupled to a return conduit. The return conduit includes an opening. The mitigation damper is positioned adjacent to the opening. The mitigation damper is configured to selectively allow airflow through the opening in response to a detected refrigerant leak.

13 Claims, 5 Drawing Sheets

(56) References Cited

U.S. PATENT DOCUMENTS 4,018,266 A * 4/1977 Kay ..... F24F 1/02 165/237
4,099,553 A * 7/1978 Burnham ..... F24F 3/0442 165/101
4,136,732 A * 1/1979 Demaray ..... F24F 3/0527 165/216
4,407,185 A * 10/1983 Haines ..... F24F 3/0442 165/234
4,437,608 A * 3/1984 Smith ..... F24F 11/0001 236/13
4,718,244 A * 1/1988 Kobayashi ..... B60S 1/54 236/44 C
4,887,438 A * 12/1989 Meckler ..... F24D 5/12 62/271
5,267,451 A * 12/1993 Cleveland ..... F24F 11/027 165/108
5,346,127 A * 9/1994 Creighton ..... G05D 23/138 165/248
5,479,787 A * 1/1996 Carter ..... F24F 1/00 454/236
5,579,993 A * 12/1996 Ahmed ..... F24F 11/0009 236/49.3
5,590,830 A * 1/1997 Kettler ..... F24F 3/044 236/49.3
5,597,354 A * 1/1997 Janu ..... F24F 11/30 454/229
5,918,475 A * 7/1999 Sakakibara ..... B60H 1/008 62/126
6,071,189 A * 6/2000 Blalock ..... F24F 3/044 454/236
6,415,617 B1 * 7/2002 Seem ..... F24F 3/044 137/84
6,427,454 B1 * 8/2002 West ..... F24F 3/153 62/176.1
6,514,138 B2 * 2/2003 Estepp ..... F24F 11/043 454/229
6,579,993 B2 * 6/2003 Hilden ..... C07D 307/87 549/492
6,604,688 B2 * 8/2003 Ganesh ..... F24F 3/1405 165/217
6,629,886 B1 * 10/2003 Estepp ..... F24F 11/745 454/229
6,698,219 B2 * 3/2004 Sekhar ..... F24F 3/0442 62/179
6,719,625 B2 * 4/2004 Federspiel ..... B61D 27/00 454/256
6,722,154 B1 * 4/2004 Tan ..... B01D 53/265 62/106
6,749,125 B1 6/2004 Carson et al.
7,017,827 B2 * 3/2006 Shah ..... F24F 3/0442 165/217
7,341,201 B2 * 3/2008 Stanimirovic ..... F24F 11/0086 236/49.1
10,001,289 B2 * 6/2018 Mowris ..... F24F 11/32
10,514,176 B2 * 12/2019 Weinert ..... F24F 1/0041
10,533,764 B2 * 1/2020 Yamada ..... F25B 41/20
10,935,454 B2 * 3/2021 Kester ..... G01M 3/226
2005/0103029 A1 * 5/2005 Kawahara ..... F25D 29/008 62/126
2012/0052791 A1 3/2012 Kurelowech
2012/0071082 A1 3/2012 Karamanos
2014/0033752 A1 2/2014 Gunjima et al.
2015/0323225 A1 * 11/2015 Matsumoto ..... F25B 5/04 62/324.1
2016/0363358 A1 * 12/2016 Papas ..... F25B 49/005
2016/0370029 A1 * 12/2016 Kurelowech ..... F24F 12/006
2018/0106492 A1 * 4/2018 Papas ..... F24F 11/37
2019/0170383 A1 * 6/2019 Weinert ..... F25B 49/025
2019/0170604 A1 * 6/2019 Kester ..... G01M 3/2807
2019/0242602 A1 * 8/2019 Yamada ..... F25B 13/00
2020/0141601 A1 * 5/2020 Weinert ..... F24F 11/36

FOREIGN PATENT DOCUMENTS

JP H10281569 A 10/1998
JP H10300294 A 11/1998
JP 2001134827 A 5/2001
JP 2002115939 A 4/2002
JP 3291407 B2 6/2002
JP 2011127847 A 6/2011
KR 20090097587 A 9/2009

* cited by examiner

SYSTEM AND METHOD OF DILUTING A LEAKED REFRIGERANT IN AN HVAC/R SYSTEM

CROSS REFERENCE TO RELATED APPLICATIONS

The present application is related to, and claims the priority benefit of, U.S. Provisional Patent Application Ser. No. 62/173,058 filed Jun. 9, 2015, the contents of which are hereby incorporated in their entirety into the present disclosure.

TECHNICAL FIELD OF THE DISCLOSED EMBODIMENTS

The presently disclosed embodiments generally relate to heating, ventilation, air conditioning, and refrigeration (HVAC/R) systems, and more particularly, to a system and method of diluting a leaked refrigerant in an HVAC/R system.

BACKGROUND OF THE DISCLOSED EMBODIMENTS

Refrigeration systems, as used in HVAC/R applications, utilize a closed loop refrigerant circuit to condition air inside an interior space. Over the years, the HVAC industry has been using refrigerants with ozone depleting chlorofluorocarbons (CFCs) and hydrochlorofluorocarbons (HCFCs); however, the use of ozone depleting refrigerants is currently being phased out of the industry.

New refrigerants have been developed to comply with environmental regulations relating to global warming potential (GWP). In order to comply with the proposed GWP regulations, hydrofluorocarbon (HFC) and hydrocarbon refrigerants with various levels of flammability are being developed and are being considered for use in HVAC/R systems.

As with any system, there is a potential for flammable refrigerants used in HVAC/R applications to leak and migrate to undesirable areas in the vicinity of the HVAC/R system. When the flammable refrigerants, in the presence of air or another oxidizer, are exposed to an ignition source, the potential for a combustion event exists if the mixture is above the lower flammability limit (LFL) and below the upper flammability limit (UFL). There is therefore a need for an HVAC/R system which mitigates the possibility of igniting a leaked refrigerant.

SUMMARY OF THE DISCLOSED EMBODIMENTS

In one aspect, an HVAC/R system is provided. The HVAC/R system includes a mitigation damper disposed within a return air conduit, wherein the return air conduit includes an opening adjacent to the mitigation damper. The mitigation damper includes a first portion operably coupled to a rotating component. In an embodiment, the first portion is positioned to cover the opening when the mitigation damper is in a closed position. In another embodiment, the mitigation damper further includes a second portion operably coupled to the rotating component. In this embodiment, the second portion is positioned to cover the opening from the exterior of the return air conduit when the mitigation damper is in a closed position, and the first portion is located within the interior of the return conduit. In an embodiment, the first and second portions of the mitigation damper are the same. In another embodiment, the first and second portions of the mitigation damper are the different. In one embodiment, the rotating component is selected from a group consisting of a motorized and non-motorized hinge.

The system further includes at least one HVAC component operably coupled to the return air conduit, the at least one HVAC component being configured to allow a refrigerant to flow therethrough. In one embodiment, the refrigerant may be a flammable refrigerant. In one embodiment, the flammable refrigerant includes difluoromethane (R32), and in another embodiment the flammable refrigerant includes 2,3,3,3-tetrafluoro-1-propene (R1234yf). In an embodiment, the at least one HVAC component may be a combination of an evaporator coil and a furnace. In another embodiment, the at least one HVAC component may be a refrigeration unit.

In one aspect, a method of diluting a leaked refrigerant in the HVAC/R system with the mitigation damper is provided. The method includes the step of determining whether a refrigerant leak has been detected. If a refrigerant leak is not detected, the HVAC/R system continues normal operation.

The method further includes the step of operating the mitigation damper from a closed position to an open position if a refrigerant leak is detected. In an embodiment, the step further includes operating the blower motor if a refrigerant leak is detected.

BRIEF DESCRIPTION OF DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
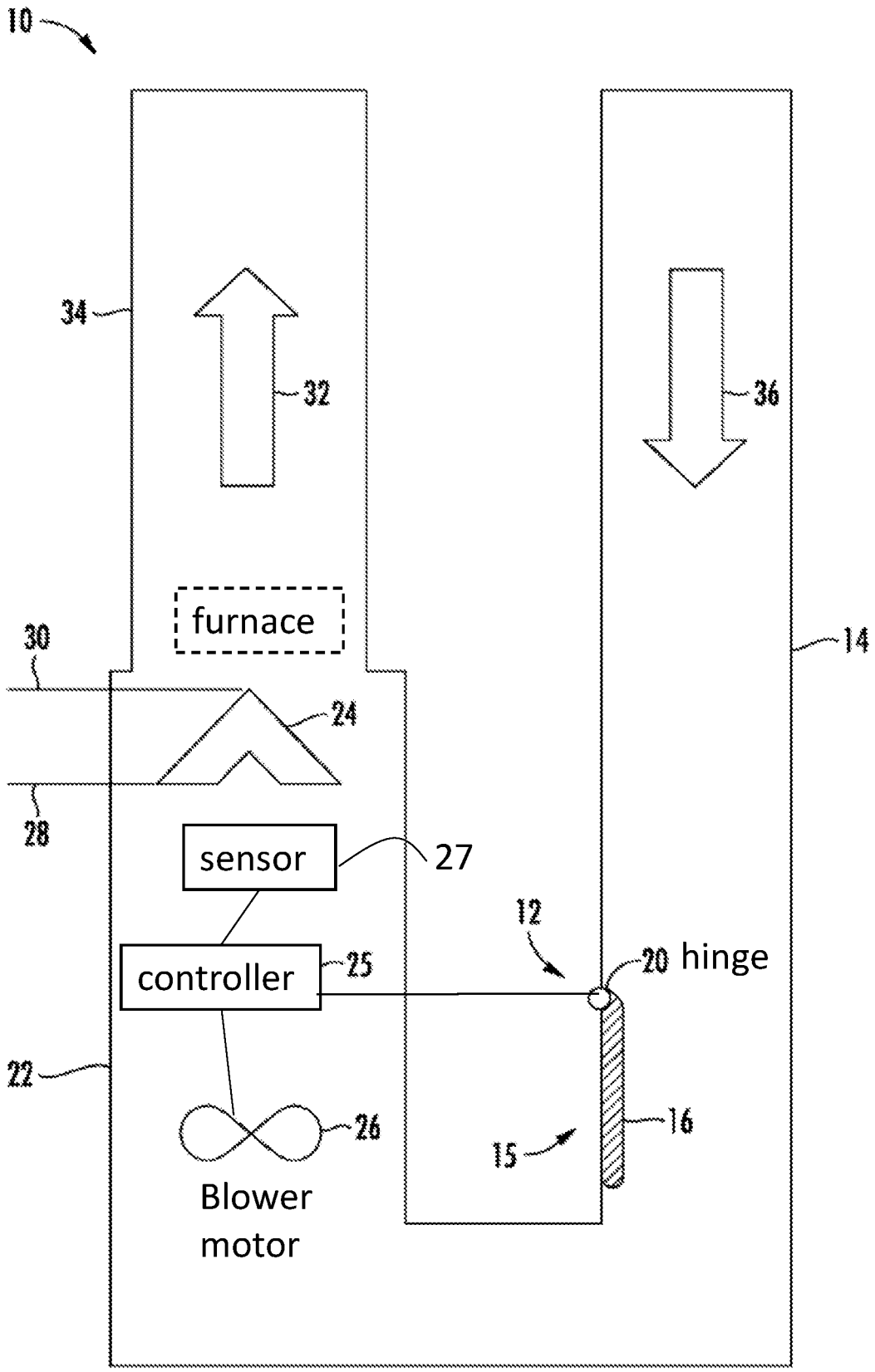
FIG. 1 is a schematic diagram of a HVAC system with an embodiment of a mitigation damper in a closed position.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 2:
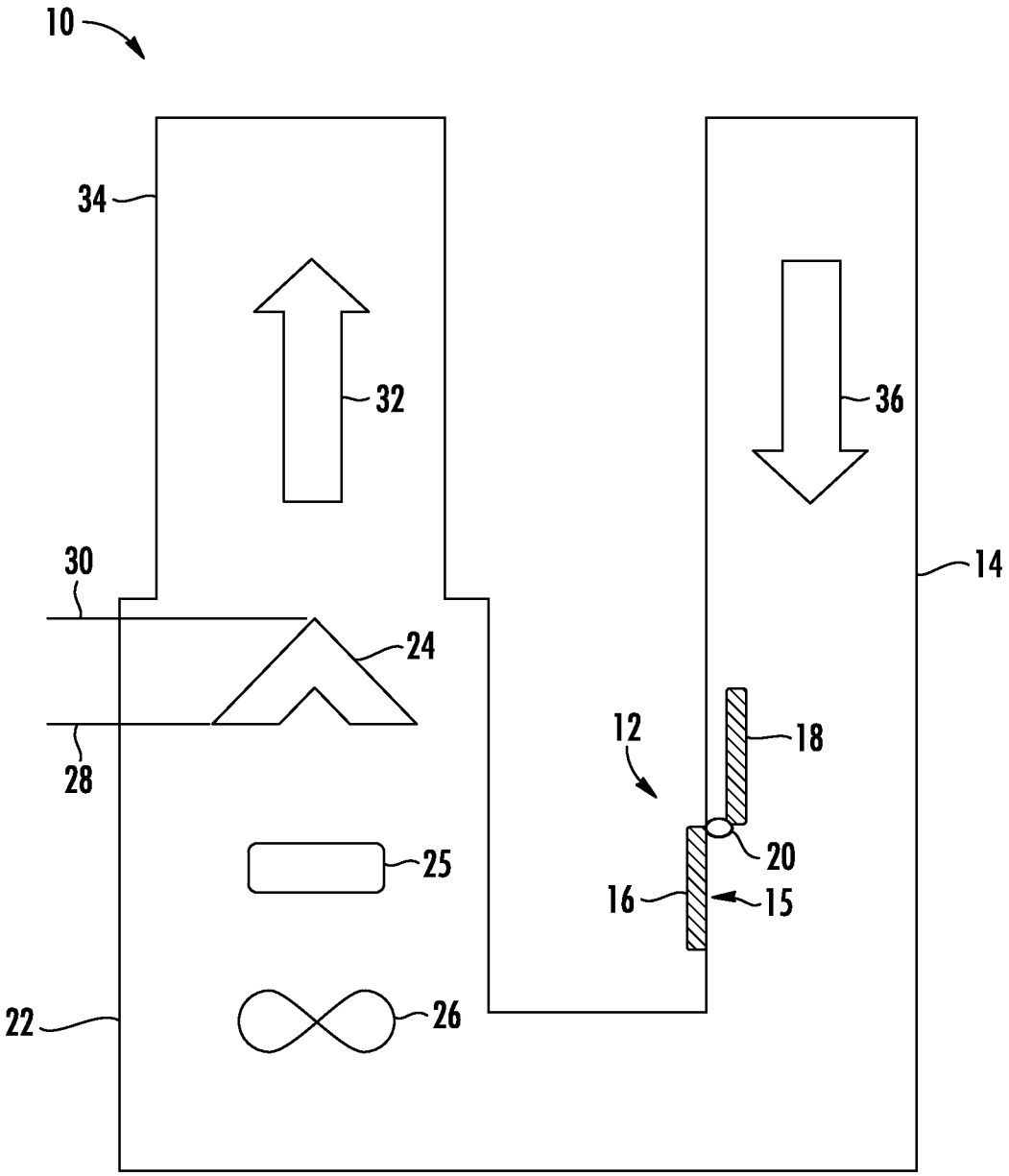
FIG. 2 is a schematic diagram of a HVAC system with another embodiment of a mitigation damper in a closed position.

FIG. 1 illustrates a schematic diagram of an embodiment of a heating, ventilation, air conditioning, and refrigeration (HVAC/R) system in an embodiment of the present disclosure, indicated generally at 10. The HVAC/R system 10 includes a mitigation damper 12 disposed within a return air conduit 14, wherein the return air conduit 14 includes an opening 15 adjacent to the mitigation damper 12. The mitigation damper 12 includes a first portion 16 operably coupled to a rotating component 20. In an embodiment, the first portion 16 is positioned to cover the opening 15 when the mitigation damper 12 is in a closed position. In another embodiment, as shown in FIG. 2, the mitigation damper 12 further includes a second portion 18 operably coupled to the rotating component 20. In this embodiment, the second portion 18 is located within the interior of the return conduit 14, and the first portion 16 is positioned to cover the opening 15 from the exterior of the return air conduit 14 when the mitigation damper 12 is in a closed position. In the embodiment of FIG. 1, the first and second portions 16, 18 of the mitigation damper 12 are the same. For example, the first and second portions, 16, 18 may be formed as a unitary piece from the same materials, have the same shape, thickness, etc. In the embodiment FIG. 2, the first and second portions 16, 18 of the mitigation damper 12 are different. The mitigation damper 12 is configured to rotate between a closed and an open position if a refrigerant leak is detected. In one embodiment, the rotating component 20 is selected from a group consisting of a motorized and non-motorized hinge. It will be appreciated that an example of a non-motorized hinge includes a spring loaded latching mechanism operable to rotate the mitigation damper 12 upon receiving an electrical signal. It will further be appreciated that the interior portion 16 and exterior portion 18 may be formed in any shape, and composed of any material suitable for blocking airflow, such as metal, plastic, wood, etc. to name a few non-limiting examples.

The system 10 further includes at least one HVAC component 22 operably coupled to the return air conduit 14, the at least one HVAC component 22 being configured to allow a refrigerant to flow therethrough. In one embodiment, the refrigerant may be a flammable refrigerant, such that the refrigerant has the ability to ignite and/or propagate a flame in the presence of air. The flammability of a refrigerant is evaluated at specific ambient conditions, including, but not limited to initial temperature, humidity, and pressure relevant to conditions of operation. In one embodiment, the flammable refrigerant includes difluoromethane (R32), and in another embodiment the flammable refrigerant includes 2,3,3,3-tetrafluoro-1-propene (R1234yf). It will be appreciated that other flammable refrigerants may be used within the HVAC/R system 10.

In the illustrated, non-limiting embodiment, the at least one HVAC component 22 is a fan coil containing an evaporator coil 24, a controller 25, and a blower motor 26 in electrical communication with the controller 25. A sensor 27 is in electrical communication with the mitigation damper 12 and the controller 25, and is configured to detect a refrigerant leak in the system 10. It will be appreciated that the sensor may be located internal or external to the at least one HVAC component 22.

In normal operation to condition an interior space, a compressor (not shown) of the HVAC/R system 10 is fluidically coupled to the evaporator coil 24. Compressed refrigerant is configured to enter the evaporator coil 24 via a refrigerant supply line 28 and is configured to exit the evaporator coil 24 via a refrigerant return line 30. As the refrigerant flows through the evaporator coil 24, the blower motor 26 operates to circulate the conditioned air 32 through a supply conduit 34 to an interior space (not shown). Return air 36 from the interior space enters the at least one HVAC component 22 via the return conduit 14. In an embodiment, the at least one HVAC component 22 may be a combination of an evaporator coil and a furnace. In another embodiment, the at least one HVAC component 22 may be a refrigeration unit.

Figure 3:
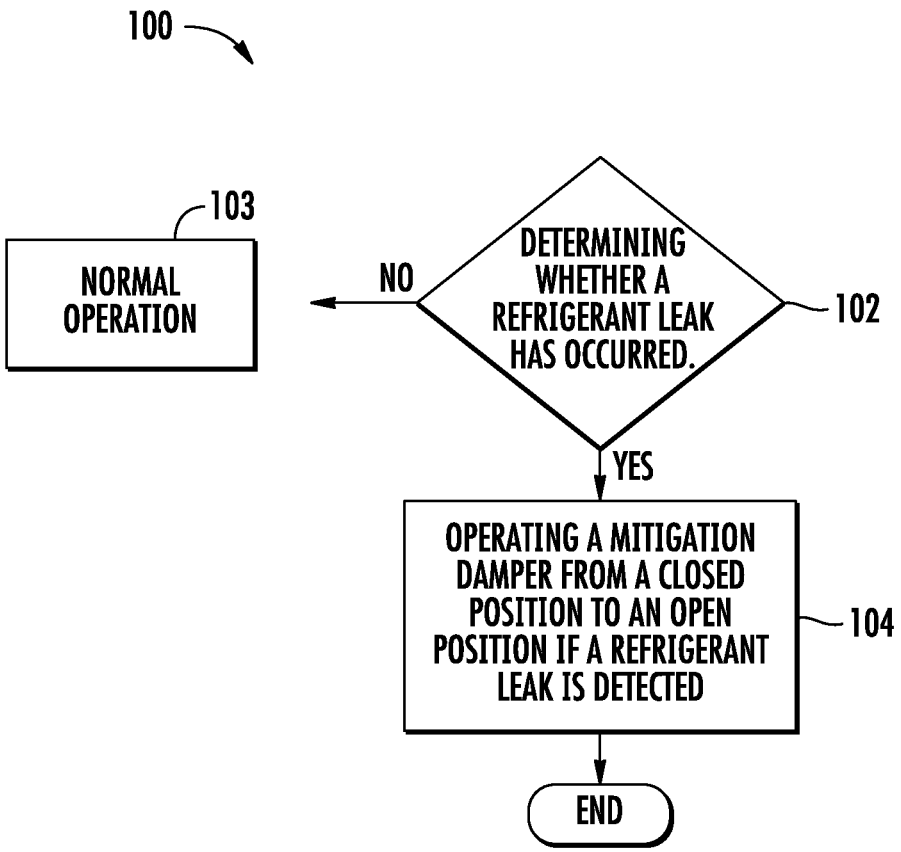
FIG. 3 is a schematic flow diagram of a method of operating the HVAC system with a mitigation damper.

FIG. 3 illustrates a method of diluting a leaked refrigerant in the HVAC/R system 10 with the mitigation damper 22, the method generally indicated at 100. The method 100 includes step 102 of determining whether a refrigerant leak has been detected. For example, the sensor 27 may be placed within the HVAC/R system 10 or in close proximity to the HVAC/R system 10 to detect any instances where refrigerant may leak from the evaporator coil 24 and migrate either outside the at least one HVAC component 22 or into one or both of the supply conduit 34 and the return conduit 14, depending on the orientation of the at least one HVAC component 22, and/or if the blower motor 26 was operational during the leak. As such, a source of ignition may come from means either within or external to the at least one HVAC component 22. If a refrigerant leak is not detected, the HVAC/R system continues normal operation, as shown in step 103.

Figure 4:
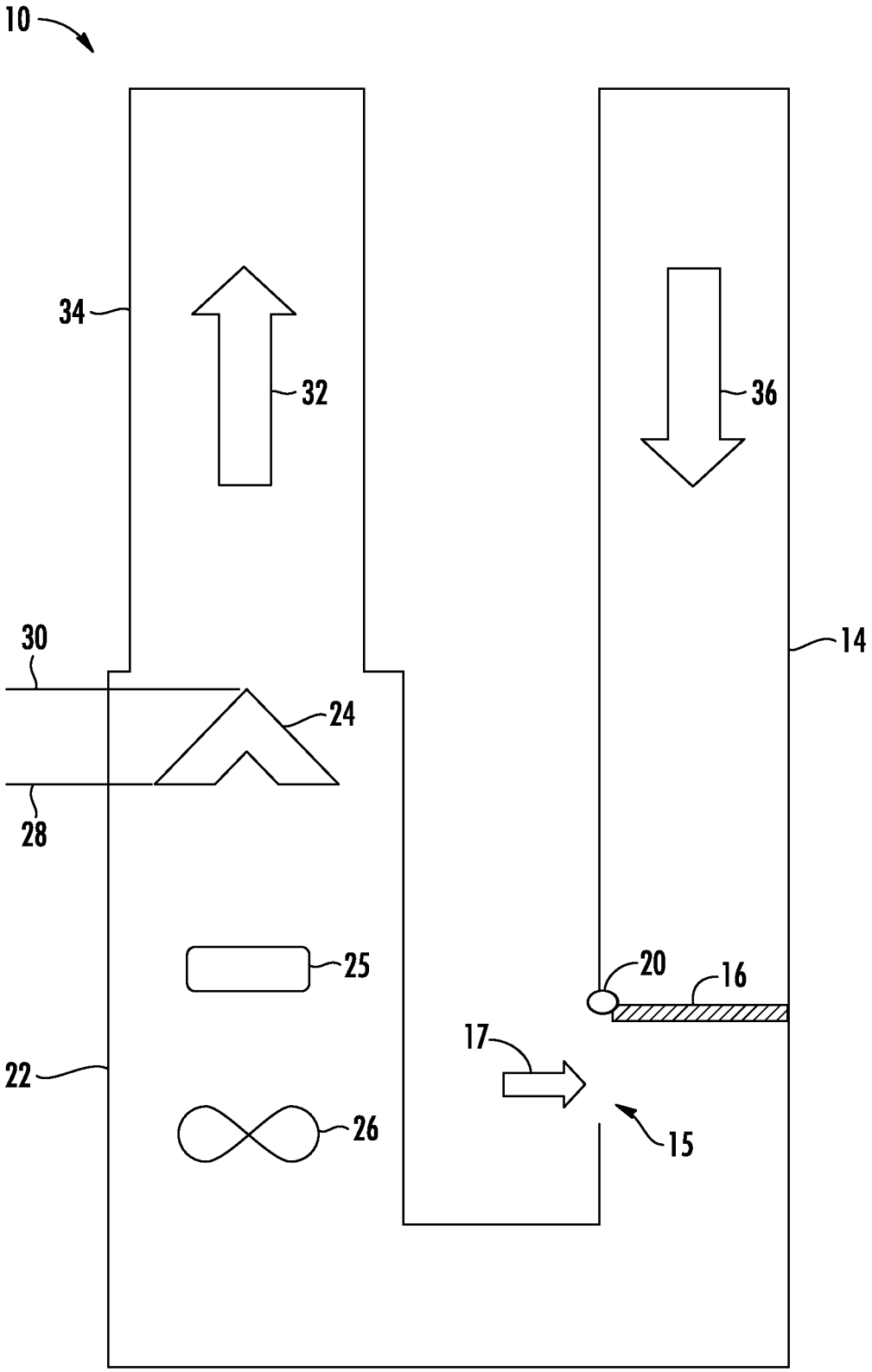
FIG. 4 is a schematic diagram of a HVAC system with an embodiment of a mitigation damper in an open position.
Figure 5:
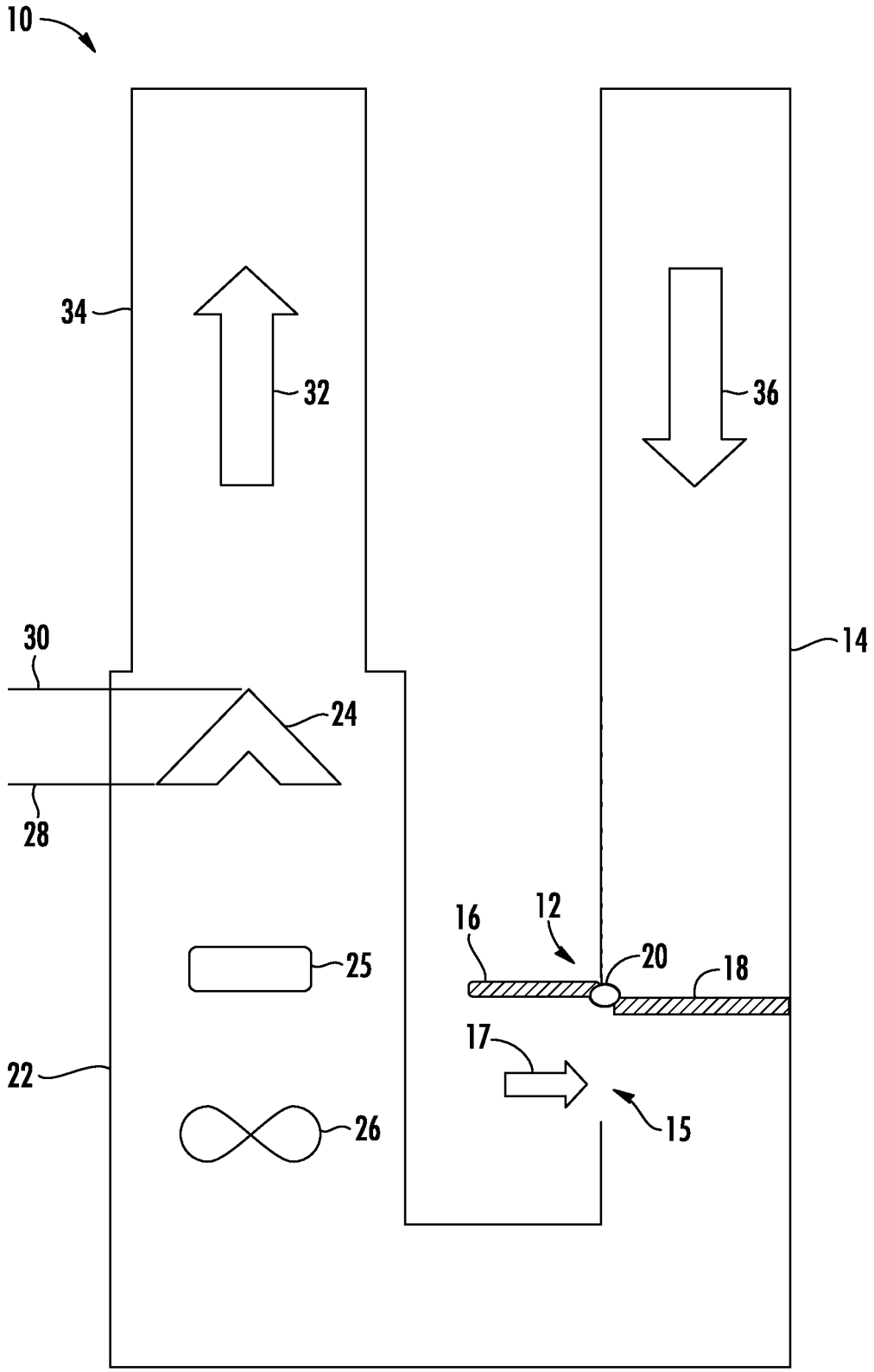
FIG. 5 is a schematic diagram of a HVAC system with an embodiment of a mitigation damper in an open position.

The method 100 further includes step 104 of operating the mitigation damper 12 from a closed position to an open position if a refrigerant leak is detected. In an embodiment, step 104 further includes operating the blower motor 26 if a refrigerant leak is detected. For example, once the sensor 27 has detected a refrigerant leak, an electrical signal is transmitted to the mitigation damper 12 to be placed in an open position such that first portion 16 rotates to block the return air 36 within the return conduit 14 and exposes the opening 15 within the return conduit 14 (see FIGS. 4 and 5). A signal may also be sent to the controller 25 to operate the blower motor 26. The opening 15 in the return conduit 14 operates to create a vacuum effect whereby the air atmosphere 17 surrounding the HVAC/R system is pulled into the opening 15. In the room in which HVAC/R system 10 is located by increasing the speed and volume of air 17 entering therein. The air 17 entrainment in the vicinity, in effect, pulls additional air into the at least one HVAC component 22 and the room in which the HVAC/R system 10 is located, thereby, diluting the leaked refrigerant to reduce the likelihood of ignition.

It will be appreciated that upon detection of a refrigerant leak, the mitigation damper 12 operates to block the return air 36 and expose an opening 15 within the return conduit 14 to increase the volume of air 17 through the at least one HVAC component 22 to dilute the leaked refrigerant as part of a mitigation strategy to prevent ignition of the refrigerant.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A system comprising:

a component configured to allow a refrigerant to flow therethrough, the component located in a supply conduit;

a return conduit operably coupled to the component, the return conduit including an opening;

a mitigation damper operably coupled to the return conduit and positioned adjacent to the opening;

a sensor configured to detect a refrigerant leak, the sensor being in electrical communication with the mitigation damper;

wherein the mitigation damper is configured to selectively allow airflow through the opening in response to the sensor having detected a refrigerant leak.

2. The system of claim 1, further comprising:

a controller in electrical communication with the sensor; and a blower motor in electrical communication with the controller.

3. The system of claim 1, wherein mitigation damper is operably coupled to a rotating component configured to provide rotation of the mitigation damper.

4. The system of claim 1, wherein the component comprises an evaporator coil.

5. The system of claim 1, wherein the component comprises a fan coil.

6. The system of claim 1, wherein the component is a refrigeration unit.

7. A method of diluting a leaked refrigerant in a system, the system including a component operably coupled to a return air conduit, and a mitigation damper operably coupled to the return air conduit, the method comprising the steps:

(a) at a controller, determining whether a refrigerant leak has occured; and (b) sending a signal to initiate operating a mitigation damper from a closed position to an open position if a refrigerant leak is detected;

wherein the component comprises an evaporator coil.

8. The method of claim 7, wherein step (b) further comprises operating a blower motor, disposed within the component, if a refrigerant leak is detected.

9. The method of claim 7, wherein a sensor is in electrical communication with the mitigation damper, and determining whether a refrigerant leak has occured comprises operating the sensor to detect a leak.

10. The method of claim 9, wherein operating the mitigation damper further comprises receiving an electrical signal from the sensor indicating a detected refrigerant leak.

11. The method of claim 9, wherein the sensor is in electrical communication with the component, and operating the blower motor further comprises receiving an electrical signal from the sensor indicating a detected refrigerant leak.

12. A system comprising:

a component configured to allow a refrigerant to flow therethrough;

a return conduit operably coupled to the component, the return conduit including an opening;

a sensor configured to detect a refrigerant leak; and a mitigation damper, a first portion of the mitigation damper configured to move from a closed position covering the opening to an open position enabling air to pass through the opening if the mitigation damper receives a signal from the sensor indicating the detected refrigerant leak;

wherein the component comprises an evaporator coil.

13. The system of claim 12, wherein a second portion of the mitigation damper is operable to block return air in the return conduit.

* * * * *